United States Patent [19]

Sresty et al.

[11] Patent Number: 4,485,868

[45] Date of Patent: Dec. 4, 1984

[54] METHOD FOR RECOVERY OF VISCOUS HYDROCARBONS BY ELECTROMAGNETIC HEATING IN SITU

[75] Inventors: Guggilam C. Sresty; Harsh Dev; Richard H. Snow, all of Chicago; Jack E. Bridges, Park Ridge, all of Ill.

[73] Assignee: IIT Research Institute, Chicago, Ill.

[21] Appl. No.: 428,081

[22] Filed: Sep. 29, 1982

[51] Int. Cl.[3] ..... E21B 43/24

[52] U.S. Cl. ..... 166/248; 166/263; 166/302

[58] Field of Search ..... 166/248, 263, 272, 302

[56] References Cited

U.S. PATENT DOCUMENTS 3,605,888 9/1971 Crowson et al. ..... 166/248

3,946,809 3/1976 Hagedorn ..... 166/263 X

*Primary Examiner*—George A. Suchfield

*Attorney, Agent, or Firm*—Fitch, Even, Tabin & Flannery

[57] ABSTRACT

A method of electromagnetic heating in situ recovers liquid hydrocarbons from an earth formation containing viscous hydrocarbonaceous liquid and water in an inorganic matrix where the formation is substantially impermeable to fluids under native conditions. A block of earth formation is substantially uniformly heated with electromagnetic power to a temperature at which the viscous hydrocarbonaceous liquid is relatively fluid and a portion of the water vaporizes to water vapor at a pressure sufficient to overcome the capillary pressure of the liquid in the matrix. Water vapor thereupon escaping from the block under such pressure is recovered with hydrocarbonaceous liquid driven thereby. The magnitude of the electromagnetic power is controlled to limit the current recovery ratio of water vapor to hydrocarboneous liquid below a predetermined limit assuring substantial recovery of the hydrocarbonaceous liquid prior to the driving off of substantially all the water.

22 Claims, 10 Drawing Figures

VISCOSITY OF BITUMEN, $\mu_{hc}$ IN CENTISTOKES
100,000
10,000
1000
100
10
150
125
100
75
50
35
TEMPERATURE, °C

BITUMEN RATE OF PRODUCTION, % OF TOTAL PER DAY
0.20
0.15
0.10
0.05
5.3 PSI STEAM DRIVE
INCREASED STEAM DRIVE
GRAVITY DRAINAGE
25
50
75
100
125
150
175
TIME OF PRODUCTION, DAYS

CUMULATIVE PRODUCTION OF BITUMEN, % OF TOTAL
0
10
20
30
40
50
60
5.3 PSI STEAM DRIVE
GRAVITY DRAINAGE
0
100
200
300
400
500
600
700
800
900
1000
TIME OF PRODUCTION, DAYS

CAPILLARY PRESSURE, PSI
0
4
8
12
16
20
24
28
0
20
40
60
80
100
PERCENT OIL SATURATION

METHOD FOR RECOVERY OF VISCOUS HYDROCARBONS BY ELECTROMAGNETIC HEATING IN SITU

BACKGROUND OF THE INVENTION

This invention relates generally to the recovery of marketable products such as oil and gas from substantially fluid impermeable deposits of viscous hydrocarbonaceous liquid in an inorganic matrix such as tar sand, by the application of electromagnetic energy to heat the deposits. More specifically, the invention relates to a method for recovering hydrocarbonaceous liquids from such formations by controlled electromagnetic heating to vaporize water therein to drive out such liquids, while controlling the electromagnetic power to limit the vaporization of water to control the resulting steam drive. The invention relates particularly to such method including use of a high power radio frequency signal generator and an arrangement of elongated electrodes inserted in the earth formations for applying electromagnetic energy to provide controlled heating of the formations.

Vast amounts of hydrocarbons are contained in deposits from which they cannot be produced by conventional oil production techniques because the hydrocarbons are too viscous and the formations are substantially fluid impermeable. Such deposits include the Utah tar sand deposits estimated to contain 26 billion barrels of bitumen. They include enormous tar sand deposits in Western Canada and other deposits of viscous oils.

It is well known to mine tar sands, heating the mined tar sands on the surface of the earth to an appropriate temperature in the presence of aqueous surfactant solutions, and recovering the products thereupon released from the matrix. In the case of tar sands, the volume of material to be handled, as compared to the amount of recovered product, is relatively large, since bitumen typically constitutes only about ten percent of the total by weight. Material handling of tar sands is particularly difficult even under the best of conditions, and the problems of waste disposal are substantial.

A number of proposals have been made for in situ methods of processing and recovering valuable products from hydrocarbonaceous deposits. Such methods may involve underground heating or retorting of material in place, with little or no mining or disposal of solid material in the formation. Valuable constituents of the formation, including heated liquids of reduced viscosity, may be drawn to the surface by a pumping system or forced to the surface by injecting another substance into the formation. It is important to the success of such methods that the amount of energy required to effect the extraction be minimized.

It has been known to heat relatively large volumes of hydrocarbonaceous formations in situ using radio frequency energy. This is disclosed in Bridges and Taflove U.S. Pat. No. Re. 30,738. That patent discloses a system and method for in situ heat processing of hydrocarbonaceous earth formations wherein a plurality of conductive means are inserted in the formations and bound a particular volume of the formations. As used therein, the term "bounding a particular volume" was intended to mean that the volume was enclosed on at least two sides thereof. In the most practical implementations, the enclosed sides were enclosed in an electrical sense, and the conductors forming a particular side could be an array of spaced conductors. Electrical excitation means were provided for establishing alternating electric fields in the volume. The frequency of the excitation means was selected as a function of the dimensions of the bounded volume so as to establish a substantially non-radiating electric field which was substantially confined in such volume. In this manner, volumetric heating of the formations occurred to effect approximately uniform heating of the volumes.

In an embodiment of the system described in that patent as applied to tar sands, the frequency of the excitation was chosen to assure adequate absorption for uniform heating while being sufficiently low to prevent radiation. In that embodiment, the conductive means comprised conductors disposed in respective opposing spaced rows of boreholes in the formations. One structure employed three spaced rows of conductors which formed a triplate type of waveguide structure. The stated excitation was applied as a voltage, for example, between difficult groups of the conductive means or as a dipole source, or as a current which excited at least one current loop in the volume. Particularly as the energy was coupled to the formations from electric fields created between respective conductors, such conductors were, and are, often referred to as electrodes.

Materials such as viscous oils and tar sands are amenable to heat processing to produce gases and hydrocarbonaceous liquids. Generally, the heat develops the permeability and/or mobility necessary for recovery. Tar sands is an erratic mixture of sand, water and bitumen with the bitumen typically present as a film around water-enveloped sand particles. Using various types of heat processing, the bitumen can be separated.

SUMMARY OF THE INVENTION

The present invention is an improvement upon the method described in U.S. Pat. No. Re. 30,738 and may utilize the same sort of waveguide structure, preferably, but not necessarily always, in the form of the same triplate transmission line. The teachings of that reissue patent are hereby incorporated herein by reference.

In the performance of the method of the reissue patent in tar sands, it was observed that under conditions of rapid heating to high temperatures, steam and gas were produced along with hydrocarbonaceous liquid. Although the steam and gas inherently drove some liquid from the formations, no particular effort was made to control the production of the steam or gas. In general, it has in the past been contemplated that the triplate system of the reissue patent normally be used to heat formations relatively slowly so as to minimize capital requirements and simplify electrode structures and the demands on coaxial cable designs. Heating rates of the order of 1 w/ft$^3$ have been considered for heating formations over a period of many months or years, as very little heat escapes the bounded region. At such rates of heating, the water vapor would be vaporized so slowly that insufficient pressure would be built up to overcome the capillary pressures of the liquid in the matrix, and no liquid would be recovered at all above that recovered by the action of gravity.

In the case of Canadian tar sands, it was not even contemplated that the formations be heated so hot as to boil water, as the liquid therein becomes sufficiently fluid as to flow by gravity. The boiling of water was considered a waste of energy, as it takes a good bit of energy to vaporize water, and Canadian tar sands contain a lot of water.

In Utah tar sands, on the other hand, there is so little water that it was contemplated that the formations be rapidly heated to temperatures above 150° C. to lower the viscosity of the liquid sufficiently for recovery by gravity. In tests under these conditions the water vaporized so fast as to build up pressures so high that the water vapor broke through the tar sand and was dissipated without driving much liquid ahead of it. There was no control of water vaporization.

In accordance with the present invention, the generation of water vapor is controlled to increase the recovery of hydrocarbonaceous liquid. Electromagnetic power is applied, as by the method of the reissue patent, to a block of an earth formation containing viscous hydrocarbonaceous liquid and water in an inorganic matrix to heat the block substantially uniformly to a temperature at which the viscous liquid becomes relatively fluid and a portion of the water vaporizes to water vapor at a pressure roughly sufficient to overcome the capillary pressure of the liquid in the matrix. This is just above the boiling point of water at the required pressure. The water vapor then escapes from the block, driving hydrocarbonaceous liquid before it. As pressures substantially below capillary pressure would permit escape of the water vapor while leaving the liquid in place, heating to operating temperature is preferably performed as rapidly as practical so as not to waste heat to surrounding formations or waste low pressure water vapor.

Once the proper vapor pressure is reached, the application of power is controlled so as not to vaporize the water too fast. Too much power boils the water so fast that it does not escape readily and hence builds up pressure to the point where the water vapor could fracture the deposit or break a channel through the deposit and escape with the hydrocarbonaceous liquid left behind. While this recovers liquid faster, it more quickly depletes the water before as much hydrocarbonaceous liquid is recovered as is reasonably achievable. It is, therefore, an aspect of the present invention to limit the current ratio of water vapor recovered to hydrocarbonaceous liquid recovered to a predetermined limit assuring substantial recovery of the hydrocarbonaceous liquid before substantially all of the water is driven off. Further, as faster heating rates require more capacity in the RF cables and matching networks, it is more economical to use a heating rate as slow as is consistant with adequate pressure generation.

Once substantially all the water is driven off, it is no longer possible to provide autogenous steam drive. In accordance with one form of the present method, the formation is thereupon heated further, for example, to about 150° C., further lowering the viscosity of the retained liquid, which may then be recovered by conventional oil well producing methods, as by gravity.

It is a further aspect of the invention to heat the earth formations where appropriate after vaporization of substantially all of the water to temperatures where substantial amounts of hydrocarbonaceous gases evolve, by cracking, distillation or both, from the hydrocarbonaceous liquids at pressures sufficient to overcome capillary pressure and hence drive liquid from the formation. Still another aspect is to control the magnitude of applied electromagnetic power so as to limit the ratio of currently recovered hydrocarbonaceous liquid to currently recovered hydrocarbonaceous gas between predetermined limits assuring substantial recovery of the liquid without wastefully overheating the formation.

A primary aspect of the invention is thus to provide an electromagnetic heating method for recovering hydrocarbonaceous liquid from formations that are substantially fluid impermeable in their native state, utilizing controlled autogenous water vapor drive. Another aspect is to provide such method with controlled autogenous hydrocarbonaceous gas drive. These and other aspects, objects and advantages of the present invention will become apparent from the following detailed description, particularly when taken in conjunction with the accompanying drawings.

DETAILED DESCRIPTION OF PREFERRED EMBODIMENTS

Figure 1:
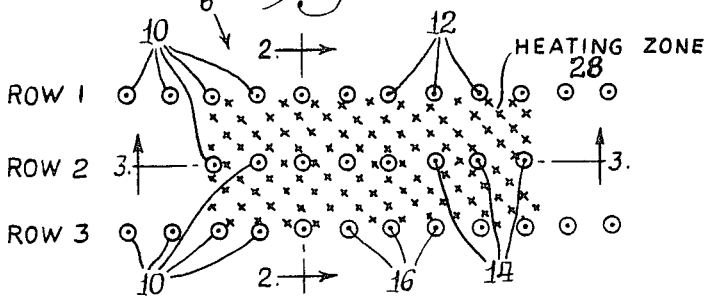
FIG. 1 is a plan view of a triplate waveguide structure disposed in earth formations in accordance with an embodiment of the present invention.
Figure 2:
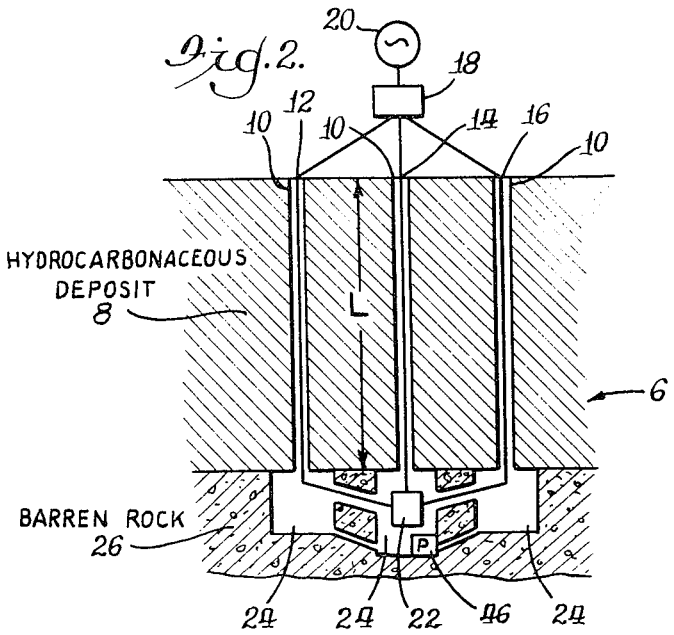
FIG. 2 is a vertical sectional view, partly diagrammatic, of the structure illustrated in FIG. 1, taken along line 2—2 in FIG. 1.
Figure 3:
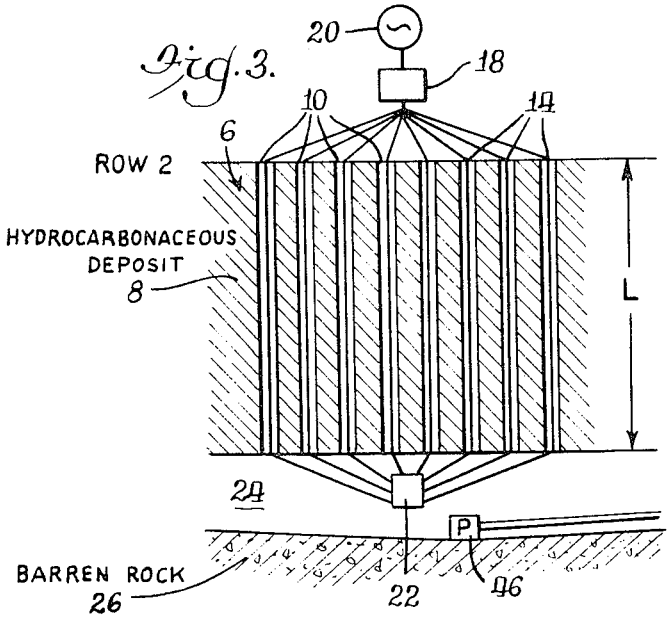
FIG. 3 is a vertical sectional view, partly diagrammatic, of the structure illustrated in FIG. 1, taken along line 3—3 in FIG. 1.

The present invention will be described primarily in respect to its application using a triplate waveguide structure as disclosed in Bridges and Taflove U.S. Pat. No. Re. 30,738. In FIGS. 1, 2 and 3 herein is illustrated a simplified construction of one form of a triplate waveguide structure 6 similar to the structure as shown in FIGS. 4*a*, 4*b* and 4*c* of the reissue patent utilizing rows of discrete electrodes to form the triplate structure. The most significant difference between the system illustrated in FIGS. 1, 2 and 3 herein and that illustrated in the reissue patent is in the termination of the waveguide structure at its lower end. It is, however, within the present invention to utilize either the systems illustrated herein or those of the reissue patent. Other types of waveguide structures could be used where at least two sides of the heated deposit are confined by electrodes.

FIG. 1 is a plan view of a surface of a hydrocarbonaceous deposit 8 having three rows 1, 2, 3 of boreholes 10 with elongated tubular electrodes 12, 14, 16 placed in the boreholes of respective rows to form the triplate waveguide 6. For the method of the present invention, the deposit 8 is an earth formation containing viscous hydrocarbonaceous liquid and water in an inorganic matrix, as occurs in tar sands in Canada and the Western United States, notably in the Utah tar sands of which the Asphalt Ridge tar sand is typical. Such formations in their native conditions are substantially impermeable to fluids.

The individual elongated tubular electrodes 12, 14, 16 are placed in respective boreholes 10 that are drilled in relatively closely spaced relationship in three straight and parallel rows 1, 2, 3, the central row 2 being flanked by rows 1 and 3. Electrodes 12 are in row 1, electrodes 14 in row 2, and electrodes 16 in row 3. The rows are spaced far apart relative to the spacing of adjacent electrodes of a row. FIG. 2 shows one electrode of each row. FIG. 3 illustrates the electrodes 14 of the central row, row 2.

In the embodiment shown, the boreholes 10 are drilled to a depth L into the formations, where L is the approximate thickness of the hydrocarbonaceous deposit 8. After insertion of the electrodes 12, 14, 16 into the respect boreholes 10, the electrodes 14 of row 2 are electrically connected together and coupled to one terminal of a matching network 18. The electrodes 12, 16 of the flanking outer rows are also connected together and coupled to the other terminal of the matching network 18. Power is applied to the waveguide structure 6 formed by the electrodes 12, 14, 16, preferably at radio frequency. Power is applied to the structure from a power supply 20 through the matching network 18, which acts to match the power source 20 to the waveguide 6 for efficient coupling of power into the waveguide. The lower ends of the electrodes are similarly connected to a termination network 22 which provides appropriate termination of the waveguide structure 6 as required in various operations utilizing the present invention. As the termination network 22 is below ground level and cannot readily be implanted or connected from the surface, lower drifts 24 are mined out of the barren rock 26 below the deposit 8 to permit access to the lower ends of the electrodes 12, 14, 16, whereby the termination network 22 can be installed and connected.

The zone 28 heated by applied energy is approximately that bounded by the electrodes 12, 16. The electrodes 12, 14, 16 of the waveguide structure 6 provide an effective confining waveguide structure for the alternating electric fields established by the electromagnetic excitation. The outer electrodes 12, 16 are commonly referred to as the ground or guard electrodes, the center electrodes 14 being commonly referred to as the excitor electrodes. Heating below L is minimized by appropriate termination of the waveguide structure at the lower end.

The use of an array of elongated cylindrical electrodes 12, 14, 16 to form a field confining waveguide structure 6 is advantageous in that installation of these units in boreholes 10 is more economical than, for example, installation of continuous plane sheets on the boundaries of the volume to be heated in situ. To achieve field confinement, the spacing between adjacent electrodes of a respective row should be less than about a quarter wavelength and preferably less than about an eighth of a wavelength.

Very large volumes of hydrocarbonaceous deposits can be heat processed using the described technique, for example, volumes of the order of $10^5$ to $10^6$ $m^3$ of tar sand. Large blocks can, if desired, be processed in sequence by extending the lengths of the rows of boreholes 10 and electrodes 12, 14, 16. Alternative field confining structures and modes of excitation are possible. Further field confinement can be provided by adding conductors in boreholes at the ends of the rows to form a shielding structure.

Figure 4:
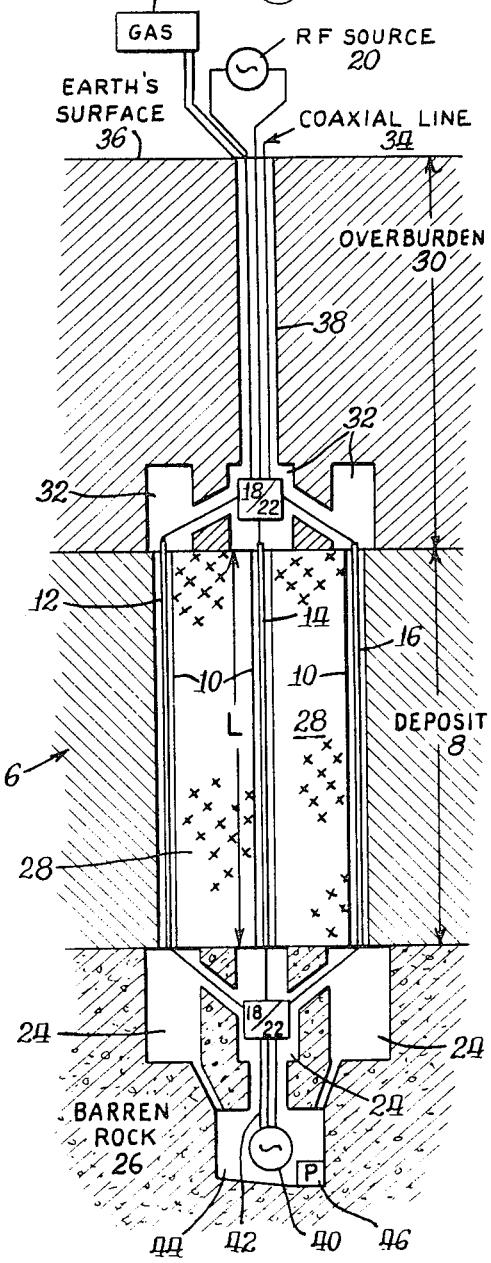
FIG. 4 is a vertical sectional view, partly diagrammatic, of another triplate waveguide structure for use in performing the present invention, wherein electromagnetic energy is applied at both ends of the waveguide structure, the view corresponding to the section taken in FIG. 2.

In FIGS. 1 to 3 it was assumed, for ease of illustration, that the hydrocarbonaceous earth formations formed a seam at or near the surface of the earth, or that any overburden had been removed. However, it will be understood that the invention is equally applicable to situations where the resource bed is less accessible and, for example, underground mining is required both above and below the deposit 8. In FIG. 4 there is shown a condition wherein a moderately deep hydrocarbonaceous bed 8, such as a tar sand layer of substantial thickness, is located beneath an overburden 30 of barren rock. In such instances, upper drifts 32 can be mined, and boreholes 10 can be drilled from these drifts. Again, each of these boreholes 10 represents one of a row of boreholes 10 for a triplate type configuration as is shown in FIG. 3. After the boreholes 10 have been drilled, respective tubular electrodes 12, 14 and 16 are lowered into the boreholes 10 in the resource bed 8. Coaxial lines 34 carry the energy from the power supply 20 at the surface 36 through a borehole 38 or an adit to the matching network 18 in a drift 32 for coupling to the respective electrodes 12, 14, 16. In this manner, there is no substantial heating of the barren rock of the overburden 30.

FIG. 4 illustrates an alternative embodiment of the present invention in that provision is made for applying power to the lower end of the triplate line 6 as well as to the upper end. To this end a second power supply 40 is provided at the lower end of the triplate line 6 and is coupled to a matching network 18 by a coaxial cable 42. The second power supply may be located in a drift 24 or in an adjacent drift 44, or it may be located at some distance, even at the surface. Indeed, the same power supply may be used for both ends of the line. In the embodiment shown in FIG. 4, a termination network 22 and a matching network 18 are supplied at each end of the waveguide structure 6. The termination/matching networks 18/22 may be of conventional construction for coupling the respective power supplies 20, 40 to the waveguide 6 and, upon switching, for terminating the waveguide with an appropriate impedance. With power applied from the upper power supply 20, the network 18 provides appropriate matching to the line, and the network 22 provides appropriate termination impedance. With power applied from the lower power supply 40, it is the other way around. The appropriate termination impedances will be whatever produces an appropriate phase of a standing wave or other desired property. Terminations for particular standing waves as produce certain desired heating patterns are set forth in the copending United States patent application of Bridges and Taflove, Ser. No. 343,903, filed Jan. 29, 1982, now U.S. Pat. No. 4,449,585, issued May 22, 1984 and assigned to the assignee hereof. The teachings of that application are hereby incorporated herein by reference.

The present invention will be described primarily in respect to its application using a triplate waveguide structure as disclosed in Bridge and Taflove U.S. Pat. No. 30,738, although a biplate waveguide could be used under certain circumstances. In FIGS. 1 to 4 herein are illustrated simplified forms of a triplate waveguide structure for the heating of large volumes of tar sand in situ using vertically emplaced tubular electrodes. This type of structure is generally suitable for heating tar sand and/or heavy oil deposits that are over 50 ft. in vertical thickness. Another simplified form of triplate waveguide structure that can be utilized to heat the deposit if the thickness is less than about 50 ft. is the horizontal structure shown in FIG. 7 of the reissue patent. However, it is within the present invention to utilize either the systems specifically illustrated herein or those of the reissue patent.

Figure 5:
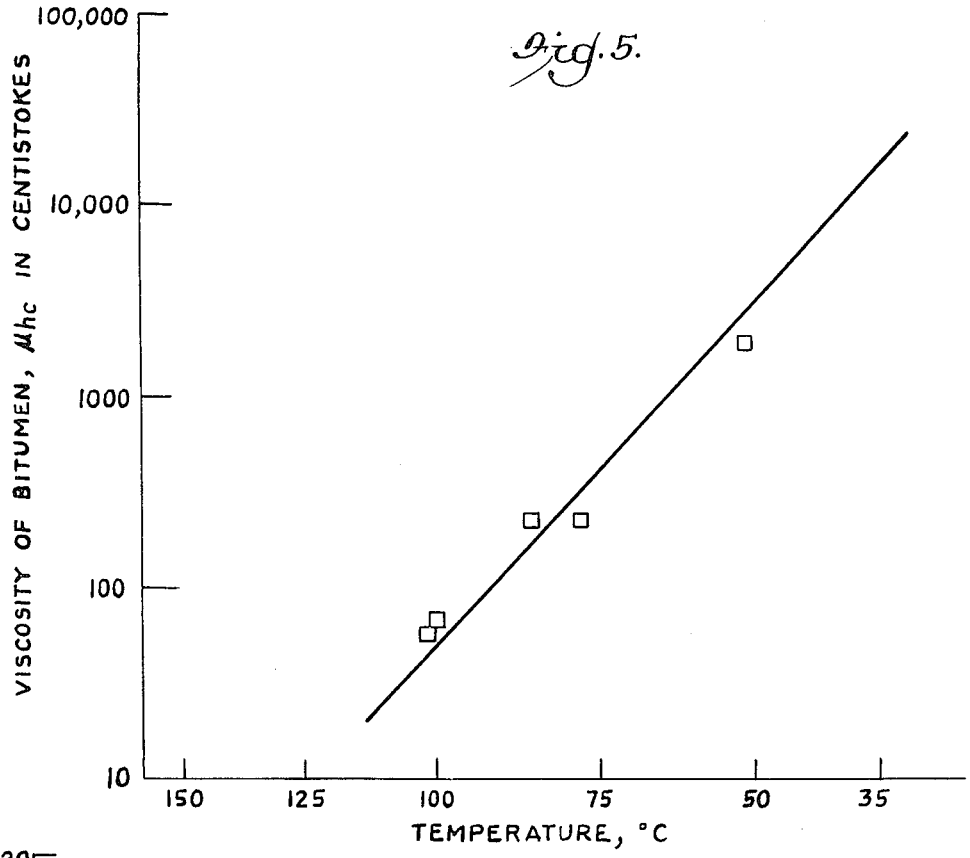
FIG. 5 is a graph showing the viscosity of bitumen from typical tar sand deposits (Asphalt Ridge) in Utah as a function of the temperature of the hydrocarbons.

The deposit confined by the two rows of guard electrodes 1 and 3 as illustrated in FIGS. 1 to 4 can be heated approximately uniformly to the desired temperature by application of electromagnetic energy to the excitor row of electrodes 2. This will result in reduction of the viscosity of the hydrocarbons and render them more fluid. In FIG. 5 is illustrated a relationship between viscosity and temperature for hydrocarbons from a typical tar sand deposit. The particular tar sand for which the property was determined is known as the Asphalt Ridge tar sand found in Utah. As shown in FIG. 5, the viscosity of the tar is reduced by more than three orders of magnitude in being heated from natural formation temperature to 100° C. This makes the tar reasonably fluid and opens up the deposit to fluid flow. Heating above 100° C. reduces the viscosity still further until substantial coking occurs at the higher temperatures.

Once the viscosity is sufficiently lowered, the liquid is driven from the formations into the respective boreholes 10, where it drains by gravity into the lower drifts 24 and/or the drift 44 or suitable sumps, whence it can be pumped to the surface by pumps 46 for refining in a conventional manner into suitable products.

The present invention provides autogenous steam drive for driving liquid from the formations. The advantages of the present invention may be demonstrated by comparison with gravity drive.

Liquid hydrocarbons can be recovered from the deposit at the elevated temperatures by gravity drainage, a technique well known in petroleum recovery. The rates of recovery by gravity drainage are rather slow and can be calculated using the following equation:

$$Q = \frac{KK_wA}{\mu_{hc}} \frac{\Delta P}{L} \quad (1)$$

where Q is the rate of recovery of liquid hydrocarbons, K is total permeability of the matrix, $K_2$ is the fractional permeability to flow of the wetting phase (liquid hydrocarbons), A is the horizontal area of the deposit from which the liquid hydrocarbons are recovered, $\Delta P$ is the pressure differential exerted by the vertical column of liquid hydrocarbons, $\mu_{hc}$ is the viscosity of the liquid hydrocarbons and L is height of the heated deposit (tubular electrodes).

Figure 6:
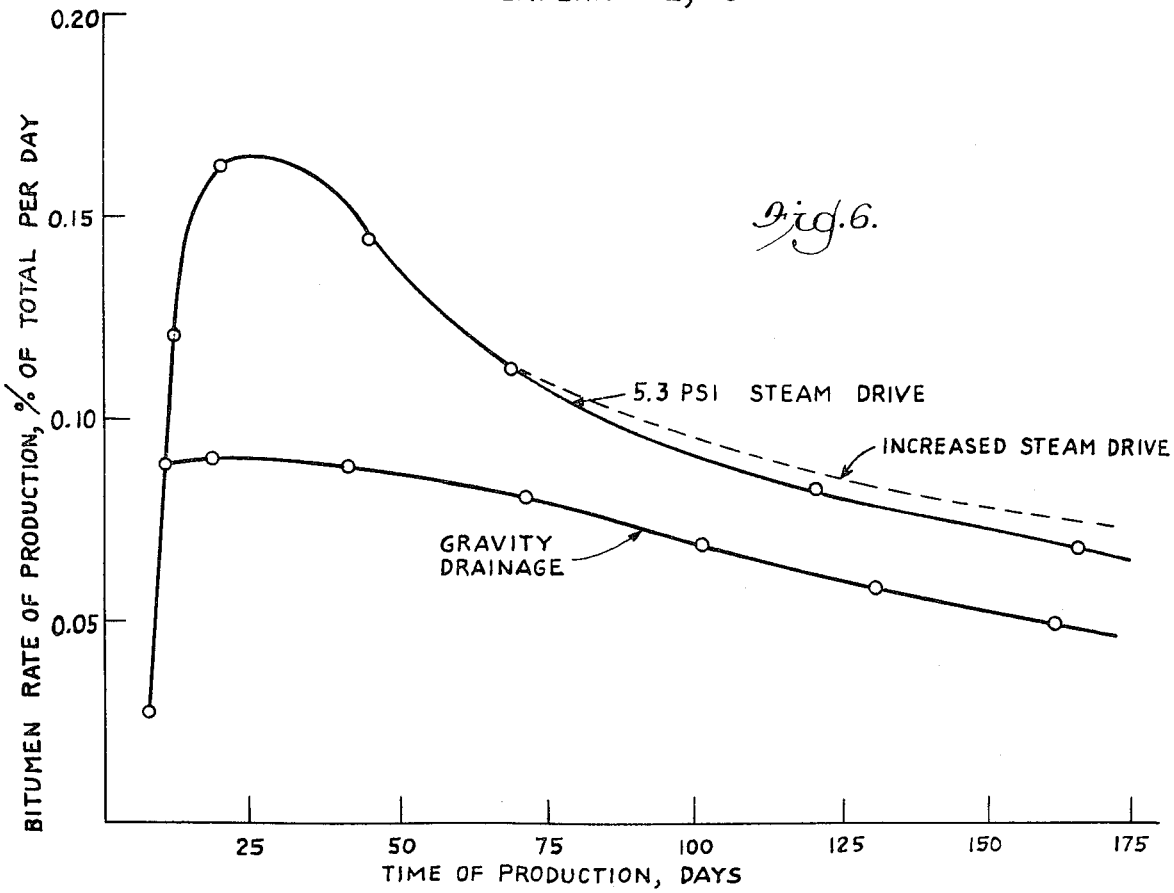
FIG. 6 is a graph illustrating rates of recovery of bitumen as a function of time from a typical tar sand deposit (Asphalt Ridge) using gravity and autogenous steam drive with the triplate waveguide structure as illustrated in FIG. 1.
Figure 7:
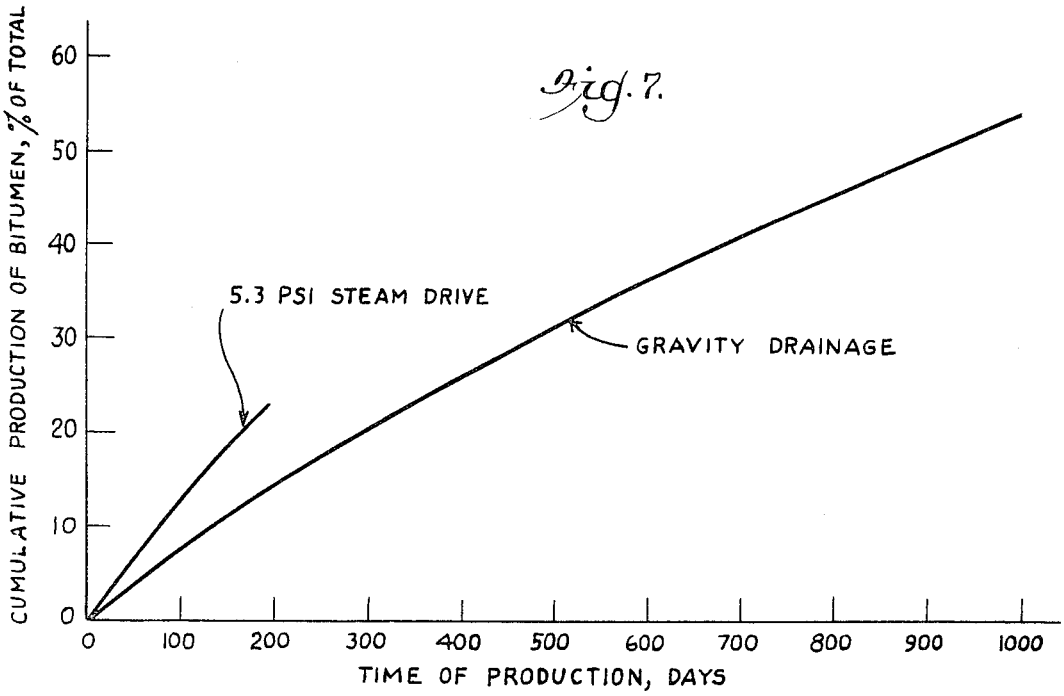
FIG. 7 is a graph illustrating total recovery of bitumen as a function of time from a typical tar sand deposit (Asphalt Ridge) by gravity drainage and by autogenously generated steam drive, being the integrals of respective curves shown in FIG. 6.

Recovery of a substantial portion of the total liquid hydrocarbons by gravity drainage requires long production times of the order of several months to several years. Time required to recover a substantial portion of the total liquid hydrocarbons also depends on the distance of separation between the tubular electrodes, since they can be perforated and used as recovery wells. The distance from the row 2 of excitor electrodes 14 to the flanking rows 1, 3 of guard electrodes 12, 16 should be between 10 and 100 feet. If the spacing is too short, the water vapor is too rapidly produced and dissipated, and if the spacing is too long, it is difficult to raise the temperature fast enough. In FIGS. 6 and 7 are illustrated the calculated values of percentage of liquid hydrocarbons recovered by gravity drainage per day and cumulatively, respectively, as a function of production time for a particular electrode array in a typical Asphalt Ridge tar sand. The calculations were made for electrode spacing of 20 m between rows and 10 m between electrodes in a row, with 0.15 m diameter electrodes perforated over 3 m from the bottom. The calculations were made for a viscosity of 100 centipoise, which is reached about 100° C. FIG. 6 shows the rate of recovery in units of percentage of total bitumen per day as a function of time. The low production rate during the first few days is occasioned by the time taken to heat up the formation and to lower the viscosity and increase the permeability so that the liquid may flow out of the formation. FIG. 7 shows the integral of the recovery, showing cumulative recovery in units of percentage of total bitumen as a function of time. FIG. 7 shows that for this example it takes about three years to recover half the bitumen. It would take years longer to recover 80% of the bitumen, which is about all that can be recovered by gravity drainage because of surface tension and consequent capillary pressure. Further, it will ordinarily be desirable to heat the deposit during this period to offset the heat lost by thermal conduction from the confined volume to the surroundings to prevent cooling of the deposit and consequent increase in viscosity of the hydrocarbons.

Figure 8:
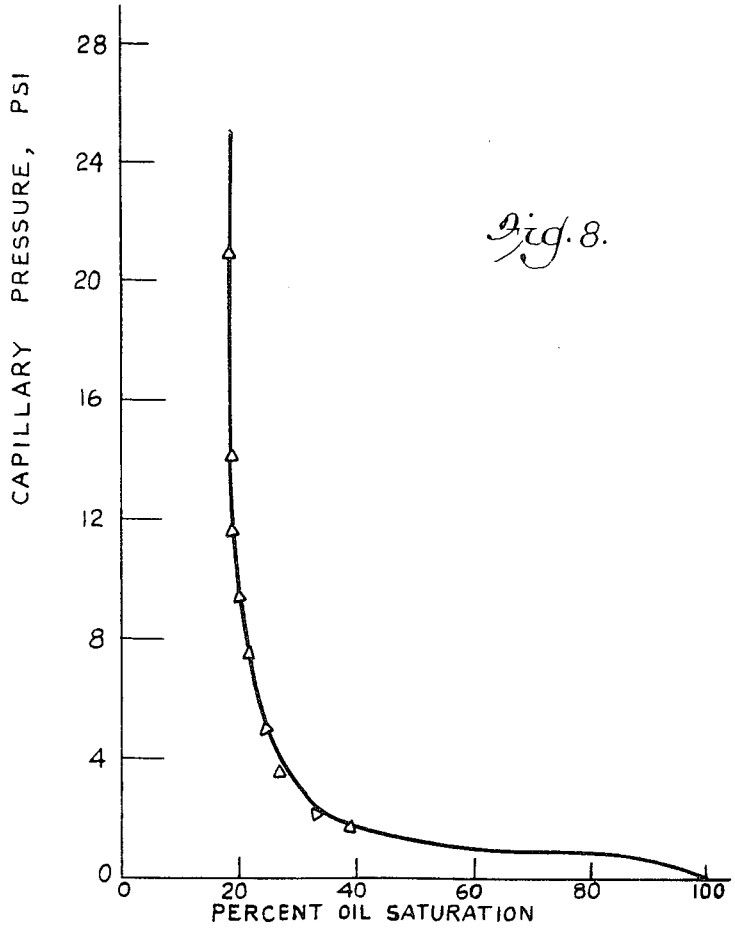
FIG. 8 is a graph illustrating the capillary pressure of liquid hydrocarbons in a tar sand sample from the Asphalt Ridge deposit in Utah for various saturations of the liquid hydrocarbons.

The primary objective of the present invention is to enhance the rate of recovery of liquid hydrocarbons above that available from gravity drainage so that the recoverable hydrocarbons can be recovered over a reasonable period of time. In accordance with the present invention, the rate of recovery of hydrocarbons can be enhanced initially by controlling the rate of electromagnetic energy input so that the water naturally found within the deposit vaporizes to water vapor at a pressure that is roughly sufficient to overcome the capillary pressure of the hydrocarbons in the deposit. Depending upon saturation, this requires vapor pressures of about 1 to 50 psi. Capillary pressure values of hydrocarbons from the Asphalt Ridge tar sand deposit are shown in FIG. 8. Calculated values showing the enhancement in recovery rates by generating water vapor at a pressure of 5.3 psig (20 psia) are illustrated in FIGS. 6 and 7.

It is essential to control the electromagnetic energy input levels during water evaporation so that the produced water vapor is at a pressure that is appropriately above the capillary pressure of the liquid hydrocarbons in the deposit for current fluid saturations, preferably about 1 to 5 psi above the capillary pressure. Under conditions where the deposit is not pressurized, extremely low electromagnetic energy input levels result in the slow production of water vapor, which can flow through the deposit without generating the required pressures. Extremely high electromagnetic energy input levels will result in high temperatures and higher pressures. However, this would ultimately cause excessive pressure build-up and induce fractures or break through channels for the flow of the water vapor without providing a drive for recovery of the said hydrocarbons. Excessive heating rates also increase equipment requirements and, hence, capital costs. The approximate rate of production of water vapor through vaporization of the water within the deposit at the vaporization temperatures (for given pressures) can be calculated using the following equation:

$$q_{wv} \cong \frac{W_e}{H_e} \tag{2}$$

where $q_{wv}$ is the rate of water vapor production, $W_e$ is the electromagnetic energy input level and $H_e$ is the latent heat of vaporization of water within the deposit under current conditions. Pressure generated by vaporizing water (assuming radial flow for simplicity) at any given electromagnetic energy input level can be calculated using the following equation:

$$P_e \frac{W_e \mu_{wv} \ln \frac{S}{2r_w}}{2\pi H_e K K_{nw} S} + P_w \tag{3}$$

where $P_e$ is the pressure in atmospheres at a point in the center between two rows of tubular electrodes 12, 14, and 16, $P_w$ is the pressure in atmospheres at the tubular electrodes 12, 14 and 16, $\mu_{wv}$ is the viscosity of the water vapor, S is the distance between rows of tubular electrodes 12, 14 and 16, $r_w$ is the radius of the boreholes 10, and $K_{nw}$ is the fractional permeability available to flow of the nonwetting phase (water vapor). In typical tar sands, this takes a power input of about 5 to 50 w/ft$^3$.

Figure 9:
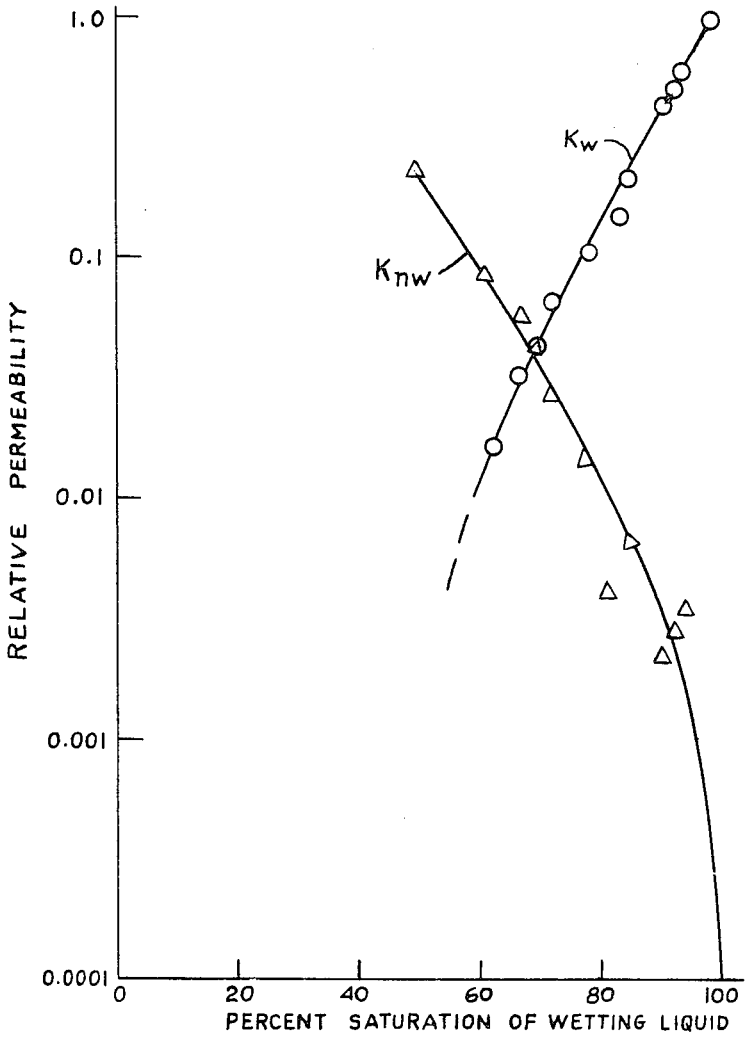
FIG. 9 is a graph illustrating the relationship between the fractional permeability to flow of the wetting phase and the nonwetting phase as a function of saturation of the wetting phase in a tar sand sample from the Asphalt Ridge deposit.

From Equation (3) it can be seen that the pressure generated by the vaporization of the water within the deposit to water vapor will depend on the spacing between the tubular electrodes 12, 14 and 16 that form the triplate waveguide structure 16, the radius of the tubular electrodes, and the fractional permeability available for flow of the produced water vapor through the deposit, which in turn depends on the current saturation of the hydrocarbons within the deposit. The fractional permeability $K_{nw}$ available for the flow of a nonwetting fluid (water vapor in this case) for an Asphalt Ridge tar sand sample is illustrated in FIG. 9 as a function of saturation of the wetting phase (liquid hydrocarbons in this case). FIG. 9 also shows the fractional permeability $K_w$ available for the flow of the wetting fluid as a function of saturation. With the recovery of hydrocarbons from the deposit, saturation of the hydrocarbon decreases, and as a result, the fractional permeability available for the flow of water vapor increases. For a given electromagnetic energy input level, the pressure generated within the deposit by evaporation of the water within the deposit to water vapor also decreases due to the increase in the fractional permeability to its flow with production of a part of the hydrocarbons. The pressure of the water vapor required to overcome the capillary pressure of the hydrocarbons increases simultaneously, as illustrated in FIG. 8. Hence it is necessary to increase the electromagnetic energy input level as hydrocarbons are recovered to produce water vapors at pressures that are sufficient to overcome the capillary pressure of the liquid hydrocarbons at current saturation conditions. This is indicated by the dashed curve in FIG. 6, which shows the increased production effected by increased steam drive as produced by a greater heating rate vaporizing the water faster to create a higher steam pressure.

It is useful to control the electromagnetic energy input levels so that water present within the deposit can be vaporized in an efficient way to recover a substantial portion of the total hydrocarbons. Under optimum conditions, the ratio of recovered water vapor to the recovered hydrocarbonaceous liquid will be according to the following equation:

$$\frac{q_{wv}}{q_{hc}} = \frac{K_{nw}\mu_{hc}}{K_w \mu_{wv}} \tag{4}$$

where $q_{wv}$ is the rate of recovery of water vapor, $q_{hc}$ is the rate of recovery of liquid hydrocarbons, $\mu_{hc}$ is viscosity of the hydrocarbons, $\mu_{wv}$ is viscosity of water vapor, $K_w$ is the fractional permeability to flow of the wetting phase (liquid hydrocarbons) and $K_{nw}$ is the fractional permeability to flow of the nonwetting phase (water vapor). The electromagnetic energy input can be adjusted to make the ratio of the order of the optimum value so that a substantial portion of the total hydrocarbons can be recovered prior to complete evaporation of the water from the deposit. It is better to stay below the optimum value to avoid wasting water, but lower ratios result in lower rates of recovery. The rate of recovery of liquid hydrocarbons can be determined at the pump 46, as by a meter. The water vapor may be recovered at the surface from the tops of the boreholes 10 or 38, as by a conventional gas collecting system 48 indicated diagrammatically in FIG. 4, where the rate of recovery of water vapor may be determined, as by a meter.

Recovery is continued with the autogenous gas drive until either the water or the hydrocarbonaceous liquid is depleted, as may be noted from a substantial decline in the rate of water vapor or hydrocarbonaceous liquid recovery or from a substantial drop in the electrical absorption properties of the block of tar sand to which the electromagnetic power is being applied. The electrical properties may be determined from the load on the power supply.

The above described Equations (2), (3) and (4) are valid for recovery of water vapor or liquid hydrocarbons under steady state saturation conditions. However, recovery of water vapor and liquid hydrocarbons under transient conditions may have some effect on the ratio of recovered water vapors to liquid hydrocarbons.

For very deep deposits with considerable overburden, it is possible to heat the deposit under confining pressure to a temperature above the boiling point of water. The release of the confining pressure will generate water vapor by the vaporization of the water deep within the deposit. Recovery of liquid hydrocarbons can be achieved by the water vapor if the initial temperature of the deposit before release of the pressure is sufficiently above the boiling point of water at atmospheric pressure as to produce water vapor, when the confining pressure is relieved, at a pressure that can roughly overcome the capillary pressure of the hydrocarbon under current saturation conditions. In this manner of operation, the rate at which the confining pressure is relieved limits the current recovery ratio of water vapor to hydrocarbonaceous liquid to the ratio discussed above for continuous heating. Liquid hydrocarbons will be recovered along with the water vapor until most of the vapor produced by release of the pressure is recovered. At this point, the deposit can be reheated using electromagnetic energy under pressure, and the pressure released after heating the deposit to a sufficient temperature for recovery of liquid hydrocarbons and water vapor. This can be repeated in a cyclic manner until most of the water within the deposit is vaporized so that a substantial portion of the hydrocarbons can be recovered prior to complete evaporation of the water within the deposit.

Because the deposit is substantially uniformly heated, the autogenously developed vapor drive will produce a high overall recovery of the hydrocarbon liquid relative to those techniques that do not produce uniform heating. Typical nonuniform heating sources include injection of steam into the deposit through injection wells, or heating of the deposit by electrical current from relatively isolated electrodes. In these cases, the deposit is more intensely heated near the point of application and underheated some distance away. In such cases, the steam formed readily escapes into boreholes without driving a significant fraction of the hydrocarbon liquid, whether the water vapor is continuously produced or in a cyclic manner as described above. As a consequence, little benefit of the drive mechanism is realized. In the case of uniform heating, all segments of the deposit generate water vapor drive, thereby assuring greater overall recoveries.

It is also possible to heat the deposit approximately uniformly under pressure to a temperature much higher than the boiling point of water, for example, to about 150° C., prior to release of the pressure to produce water vapor. Such heating will further lower the vicosity of hydrocarbonaceous liquid and reduce the ratio of the water vapor produced to hydrocarbonaceous liquid produced. This process can also be repeated in a cyclic manner until substantially all of the water is vaporized. Heating of the deposit to a temperature that is much higher than the boiling point at atmospheric pressure will be particularly helpful under instances where the water content of the deposit is relatively low and must be conserved or where heating to 100° C. does not decrease the viscosity of the hydrocarbon liquids to a sufficiently low value.

Hydrocarbons remaining within the deposit after complete evaporation of the water can be produced by several methods, including gravity drainage. The deposit can be further heated by electromagnetic energy or by injection of fluids such as air or steam to a temperature of about 150° C. to further decrease the viscosity of the hydrocarbons to enhance the rates of recovery of the liquid hydrocarbons by gravity drive.

It is also within the scope of the present invention to heat the deposit at a controlled rate so that gases generated by partial distillation of the hydrocarbons and by its slow coking can overcome the capillary pressure of the hydrocarbons and result in more rapid recovery of the liquid hydrocarbons. The electromagnetic energy input levels are controlled in the fashion described above in respect to water vaporization so that the gases generated result in recovery of a significant portion of the hydrocarbons from the heated deposit, maintaining the gas pressure above capillary pressure by 1 to 5 psi. The ratio of the gases and hydrocarbon liquids recovered will depend on the fractional permeability available to flow of both gases and liquids at current saturation levels. Under optimum conditions, the ratio of hydrocarbon gases to liquids can be calculated using the equation given below:

$$\frac{q_{hcv}}{q_{hc}} = \frac{K_{nw}\mu_{hc}}{K_w\mu_{hcv}} \tag{5}$$

where $q_{hcv}$ is the rate of recovery of hydrocarbon vapors, $q_{hc}$ is the rate of recovery of hydrocarbon liquids, $K_{nw}$ is the fractional permeability to flow of the nonwetting phase (hydrocarbon vapors) at current saturation conditions, $K_w$ is the fractional permeability to flow of the wetting phase (hydrocarbon liquids) at current saturation conditions, $\mu_{hc}$ is the viscosity of the hydrocarbon liquids, and $\mu_{hcv}$ is the viscosity of the hydrocarbon vapors. The electromagnetic energy input level can be adjusted to make the ratio of the order of the optimum value so that a substantial portion of the total hydrocarbons can be recovered without raising the temperature of the deposit excessively. It is better to stay below the optimum value to avoid wasting power, but lower ratios result in lower rates of recovery. The gas may be recovered by the gas collecting system 48, where the rate of recovery of gas may be determined, as by a meter.

Figure 10:
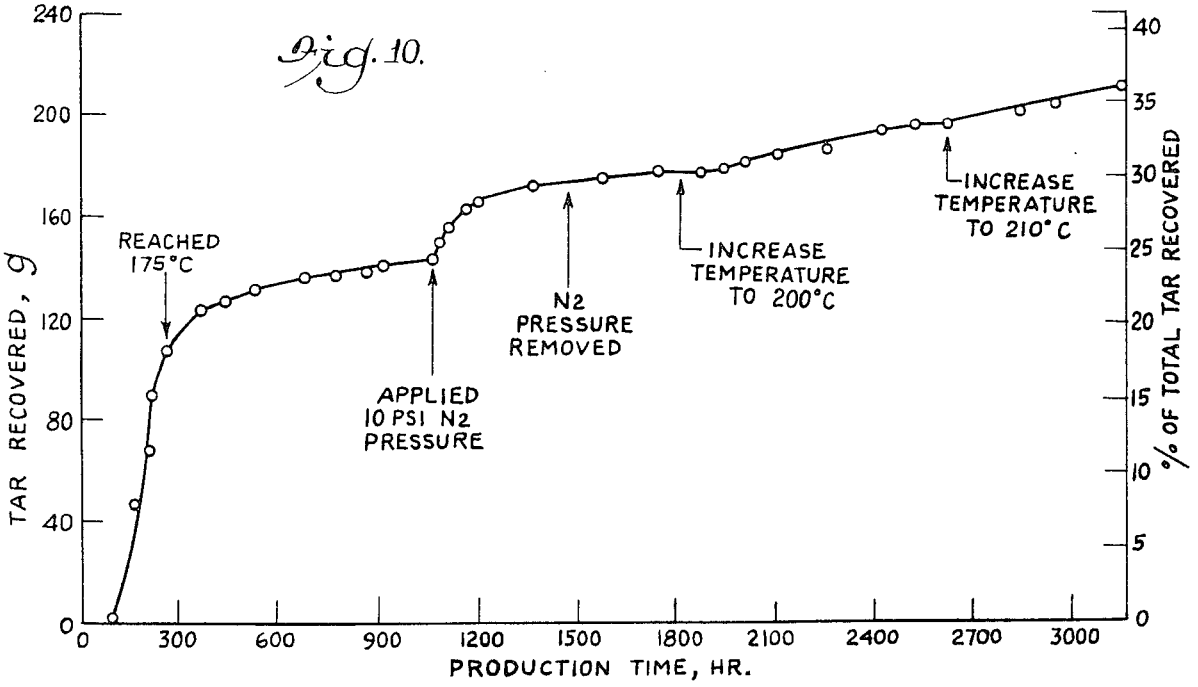
FIG. 10 is a graph illustrating the recovery of hydrocarbons by the heating of a sample from an Asphalt Ridge tar sand deposit in Utah as a function of time of production.

The increase in the recovery of liquid hydrocarbons from heating an Asphalt Ridge tar sand core sample is illustrated in FIG. 10. It may be noted that recovery becomes faster as the temperature of the core is increased from 175° to 200° C., and then again from 200° to 210° C. Reduction in viscosity of the hydrocarbons at temperatures of over 150° C. is negligible, and the increase in recovery of hydrocarbons with increase in temperatures of over 175° C. is due to the drive provided by controlled generation of autogenous hydrocarbon vapors. The deposit can be further heated to about 250° C. at a controlled rate so that a significant portion of the hydrocarbons can be recovered.

The data shown in FIG. 10 were developed from the external heating of a five foot high core sample of Asphalt Ridge tar sand, confined so that drainage was only through the bottom. The sample was rapidly heated to 175° C. This resulted in the rapid early recovery of tar, following the time needed to reduce viscosity. The heating was at a faster rate than contemplated by this invention and resulted in vaporizing substantially all of the water by the time only 20% of the tar had been recovered. By heating more slowly once the boiling boint is reached, more liquid can be driven out before all of the water is recovered as water vapor. About 33% recovery can be realized from Asphalt Ridge tar sand. A higher percentage can be realized from Canadian tar sand, which contains more water.

After the water was gone, gravity drainage (under what remained of the five foot head of oil) produced oil more gradually, at a gradually declining rate, still at 175° C. To simulate a greater head of oil, as is usually found in Asphalt Ridge tar sands, 10 psi $N_2$ was applied, resulting in a higher rate of recovery.

The external $N_2$ pressure was then removed, and the temperature was increased to 200° C., vaporizing some of the hydrocarbons and increasing the rate of production under autogenous gas drive. As liquid hydrocarbons were produced, the saturation decreased, capillary pressure increased, and gas pressure declined, resulting in a falling off of rate of production. The temperature was then increased to 210° C., vaporizing more hydrocarbons and increasing the autogenous gas pressure to produce greater drive.

As can be seen from FIG. 8, not all of the bitumen can be recovered by gravity or gas drive. Below about 20% saturation, the capillary pressure rises rather abruptly to a very high level, making gravity or gas drive ineffective, as the capillary pressure cannot be overcome at any practical drive pressure.

These data and principles may be utilized to develop suitable heating protocols for various tar sands or heavy oil deposits. For Asphalt Ridge tar sands, a specific suitable heating protocol has been worked out. The tar sand is heated relatively rapidly and relatively uniformly until the water therein begins to vaporize, at a temperture of 100° C. The heating is continued to just above 100° C. to produce water vapor at a pressure slightly overcoming the capillary pressure in the tar sand. Pore volume of the Asphalt Ridge tar sand is about 70% saturated with tar, and the capillary pressure is initially about 1 psi. At 100° C., the bitumen has a viscosity of only about 100 centipoise and is relatively fluid. The formation thereupon develops substantial permeability, and liquid hydrocarbons are recovered, further increasing permeability.

The heating is continued to vaporize the water more rapidly and maintain a vapor pressure about 1 to 5 psi above the capillary pressure as liquid hydrocarbons are recovered, further increasing permeability. At this rate about a third of the bitumen is recovered before substantially all of the water is gone.

The heating is then continued to more than 150° C. to lower the viscosity of the remaining liquid. Preferably the heating proceeds more moderately once appreciable gas is vaporized from the bitumen. This provides autogenous gas drive. The heating is controlled, however, so that the liquid is recovered at as low a temperature as practical so as not to produce excessive charring of the oil and not require so much energy to heat the formation. As oil is produced, the capillary pressure rises, and the heating is continued to produce a higher temperature to evolve more gas and thereby produce higher autogenous gas pressures to overcome the increased capillary pressure.

Finally, as the liquids are produced from the more open pores of the formation, the remaining liquid is retained in very small pores wherein surface tension develops capillary pressures so great that the liquid cannot be forced out at practical gas pressures. As this point is approached, the recovery of liquid falls off even with the increase in temperature and pressure until further heating becomes uneconomical. The method is then terminated, leaving perhaps 20% of the hydrocarbons to be recovered by other means.

Although particular preferred embodiments of the invention have been described with particularity, many modifications may be made therein within the scope of the invention. For example, water vapor and hydrocarbonaceous gas may be recovered simultaneously, particularly when the formations are heated under pressure. Also, other electrode structures may be used, and they may be disposed differently.

The invention is particularly useful for a system in which a waveguide structure is formed by electrodes disposed in earth formations, where the earth formations act as the dielectric for the waveguide, as in the triplate system illustrated. Electromagnetic energy at a selected radio frequency or at selected radio frequencies is supplied to the waveguide for controlled dissipation in the formations.

The terms "waveguide" and "waveguide structure" are used herein in the broad sense of a system of material boundaries capable of guiding electromagnetic waves. This includes the triplate transmission line formed of discrete electrodes as preferred for use in the present invention.

Unless otherwise required by the context, the term "dielectric" is used herein in the general sense of a medium capable of supporting an electric stress and recovering at least a portion of the energy required to establish an electric field therein. The term thus includes the dielectric earth media considered here as imperfect dielectrics which can be characterized by both real and imaginary components, $\epsilon'$, $\epsilon''$. A wide range of such media are included wherein $\epsilon''$ can be either larger or smaller than $\epsilon'$.

"Radio frequency" will similarly be used broadly herein, unless the context requires otherwise, to mean any frequency used for radio communications. Typically this ranges upward from 10 KHz; however, frequencies as low as 45 Hz have been considered for a world-wide communications system for submarines. The frequencies currently contemplated for tar sand deposits range as low as 50 Hz.

Mention has been made of the need for heating the formation uniformly. The object is to heat the entire block to more or less the same temperature in order that adequate autogenous steam and gas drive may operate from deep in the block. However, it is recognized that many factors may produce variations in temperature even though the driving voltages are applied relatively uniformly to the electrodes. For example, standing waves along the electrodes may provide some variations in applied power. Inhomogeneities in the formation may occasion variations in dielectric or conductive heating. Thermal conductivity differences may produce differences in temperatures. Thermal conductivity will also dissipate heat from the outer parts of the block to adjacent rock. All of this is encompassed by the term "substantially uniformly", which is therefore used herein to mean that some substantial effort is made to distribute the heating so as to provide generally uniform temperatures throughout the block as a whole, and at least out in the central regions of the block, so that a substantial portion of the block becomes adequately heated for autogenous steam and/or gas drive.

What is claimed is:

1. A method for recovering liquid hydrocarbons from an earth formation containing viscous hydrocarbonaceous liquid and water in an inorganic matrix, said formation being substantially impermeable to fluids under native conditions, said method comprising:

substantially uniformly heating a block of said earth formation with electromagnetic power to a temperature at which said viscous hydrocarbonaceous liquid is relatively fluid and a portion of said water vaporizes to water vapor at a pressure sufficient to overcome the capillary pressure of said liquid in said matrix, recovering water vapor thereupon escaping from said block under said pressure and hydrocarbonaceous liquid driven thereby, and controlling the magnitude of said electromagnetic power to limit the current recovery ratio of water vapor to hydrocarbonaceous liquid below a predetermined limit assuring substantial recovery of said hydrocarbonaceous liquid prior to the driving off of substantially all said water.

2. A method according to claim 1 wherein said electromagnetic power is applied to a plurality of electrodes bounding said block and defining a waveguide structure having said block as a dielectric medium bounded therein.

3. A method according to claim 1 wherein said electromagnetic power is applied to the electrodes of a triplate array of electrodes bounding said block and formed of a row of excitor electrodes flanked by respective rows of guard electrodes.

4. A method according to claim 3 wherein said row of excitor electrodes is spaced from said respective rows of guard electrodes by 10 to 100 feet.

5. A method according to any one of claims 1 to 4 wherein said uniform heating is continued until there is a substantial decline in rate of water vapor or hydrocarbonaceous liquid recovery.

6. A method according to any one of claims 1 to 4 wherein said uniform heating is continued until there is a substantial decrease in the electrical absorption properties of said block to which said electromagnetic power is applied.

7. A method according to any one of claims 1 and 2 to 4 wherein the magnitude of said electromagnetic power is controlled to increase the temperature of said block during said recovery of water vapor and hydrocarbonaceous liquid to offset the consequent increase in said capillary pressure as the more easily recovered said liquid is withdrawn from said block.

8. A method according to any one of claims 1 and 4 wherein wherein said vapor pressure is maintained less than 5 psi above the current average capillary pressure of said liquid in said matrix.

9. A method according to claim 8 wherein said vapor pressure is maintained at least 1 psi above said current average capillary pressure of said liquid in said matrix.

10. A method according to claim 8 wherein said further heating is performed substantially uniformly by further controlling the magnitude of said electromagnetic power.

11. A method according to any one of claims 1 to 4 wherein said current recovery ratio of water vapor to hydrocarbonaceous liquid prior to the driving off of substantially all said water is maintained at the order of the ratio $$\frac{q_{wv}}{q_{hc}} = \frac{K_{nw}\mu_{hc}}{K_w\mu_{wv}}$$

where $q_{wv}$ is the rate of recovery of water vapor, $q_{hc}$ is the rate of recovery of hydrocarbonaceous liquid, $\mu_{hc}$ is the viscosity of the hydrocarbonaceous liquid, $\mu_{wv}$ is the viscosity of water vapor, $K_w$ is the fractional permeability to flow of the hydrocarbonaceous liquid, and $K_{nw}$ is the fractional permeability of the water vapor.

12. A method according to any one of claims 1 to 4 further including: following vaporization of substantially all of said water, further heating said block of said earth formation to a temperature above 150° C. to reduce further the viscosity of the remaining hydrocarbonaceous liquid, and further recovering hydrocarbonaceous liquid from said block.

13. A method according to any one of claims 1 to 4 further including: following vaporization of substantially all of said water, further heating said block of said earth formation to temperatures at which substantial amounts of hydrocarbonaceous gas evolve from said hydrocarbonaceous liquid at pressures sufficient to overcome said capillary pressure, and recovering hydrocarbonaceous gas thereupon escaping from said block and hydrocarbonaceous liquid driven thereby.

14. A method according to claim 13 wherein said pressures of said hydrocarbonaceous gas are maintained less than 5 psi above the current average capillary pressure of said liquid in said matrix.

15. A method according to claim 14 wherein pressures of said hydrocarbonaceous gas are maintained at least 1 psi above said current average capillary pressure of said liquid in said matrix.

16. A method according to claim 13 wherein said further heating is performed substantially uniformly by further controlling the magnitude of said electromagnetic power to limit the current recovery ratio of hydrocarbonaceous gas to hydrocarbonaceous liquid between predetermined limits assuring substantial recovery of said hydrocarbonaceous liquid without wasteful heating of said block.

17. A method according to claim 13 wherein said current recovery ratio of hydrocarbonaceous gas to hydrocarbonaceous liquid prior to the recovery of substantially all of the recoverable liquid is maintained at of the order of the ratio $$(q_{hcv}/q_{hc}) = (K_{nw}\mu_{hc}/K_w\mu_{hcv})$$

where $q_{hcv}$ is the rate of recovery of hydrocarbonaceous gas, $q_{hc}$ is the rate of recovery of hydrocarbonaceous liquid, $\mu_{hc}$ is the viscosity of the hydrocarbonaceous liquid, $\mu_{hcv}$ is the viscosity of the hydrocarbonaceous gas, $K_w$ is the fractional permeability to flow of the hydrocarbonaceous liquid, and $K_{nw}$ is the fractional permeability of the hydrocarbonaceous gas.

18. The method according to any one of claims 1 to 4 wherein hydrocarbonaceous gas is recovered simultaneously with said water vapor.

19. A method according to any one of claims 1 to 4 wherein said vapor pressure is maintained at about 1 to 50 psi during said recovery of water vapor and hydrocarbonaceous liquid.

20. A method according to any one of claims 1 and 2 to 4 wherein said electromagnetic power is maintained at about 5 to 50 w/ft$^3$ during said production of water vapor and hydrocarbonaceous liquid.

21. A method for recovering liquid hydrocarbons from an earth formation containing viscous hydrocarbonaceous liquid and water in an inorganic matrix, said formation being substantially impermeable to fluids under native conditions, said method comprising:

substantially uniformly heating a block of said earth formation under confining pressure with electromagnetic power to a temperature at which said viscous hydrocarbonaceous liquid is relatively fluid and sufficiently above the boiling point of water at atmospheric pressure that when the confining pressure is relieved a portion of said water vaporizes to water vapor at a generated pressure sufficient to overcome the capillary pressure of said liquid in said matrix, relieving the confining pressure to vaporize said portion of said water and displace at least a portion of said liquid in said matrix with the vaporized water, recovering water vapor thereupon escaping from said block under said generated pressure and hydrocarbonaceous liquid driven thereby, and controlling the rate at which said confining pressure is relieved to limit the current recovery ratio of water vapor to hydrocarbonaceous liquid below a predetermined limit assuring substantial recovery of said hydrocarbonaceous liquid prior to the driving off of substantially all said water.

22. A method according to claim 21 wherein said steps of heating under pressure and relieving said pressure are repeated alternately.

* * * * *

UNITED STATES PATENT AND TRADEMARK OFFICE

CERTIFICATE OF CORRECTION

PATENT NO. : 4,485,868

DATED : December 4, 1984

INVENTOR(S) : Sresty, et al.

It is certified that error appears in the above-identified patent and that said Letters Patent is hereby corrected as shown below:

In the Abstract, line 6, before "earth" insert --the--.

In the Abstract, line 16, change "hydrocarboneous" to --hydrocarbonaceous--.

Column 2, line 29, change "sands" to --sand--.

Column 3, line 48, change "consistant" to --consistent--.

Column 7, line 9, change "Bridge" to --Bridges--.

Column 12, line 51, change "boint" to --point--.

Column 15, line 16, after "4" insert --, 21 and 22--.

Column 15, line 20, after "4" insert --, 21 and 22--.

Column 15, line 32, change "and" to --to--.

Column 15, line 33, Claim 8, delete "wherein", first occurrence.

Column 15, line 39, change "8" to --12--.

Column 15, line 43, after "4" insert --, 21 and 22--.

Column 15, line 58, after "4" insert --, 21 and 22--.

Column 15, line 65, after "4" insert --, 21 and 22--.

UNITED STATES PATENT AND TRADEMARK OFFICE

CERTIFICATE OF CORRECTION

PATENT NO. : 4,485,868

DATED : December 4, 1984

INVENTOR(S) : Sresty, et al.

It is certified that error appears in the above-identified patent and that said Letters Patent is hereby corrected as shown below:

Column 16, line 39, after "4" insert --, 21 and 22--.

Column 16, line 42, after "4" insert --, 21 and 22--.

Signed and Sealed this

*Thirtieth* Day of *July 1985*

[SEAL]

*Attest:*

DONALD J. QUIGG

*Attesting Officer*

*Acting Commissioner of Patents and Trademarks*

UNITED STATES PATENT AND TRADEMARK OFFICE

CERTIFICATE OF CORRECTION

PATENT NO. : 4,485,868

DATED : December 4, 1984

INVENTOR(S) : Guggilam C. Sresty et al.

It is certified that error appears in the above-identified patent and that said Letters Patent is hereby corrected as shown below:

Column 1, after the first paragraph insert the following paragraph: --The Government of the United States of America has rights in this invention pursuant to Contract No. DE-AC01-79ER10181 awarded by the U.S. Department of Energy.--

Signed and Sealed this

Twenty-eighth Day of November 1989

*Attest:*

JEFFREY M. SAMUELS

*Attesting Officer* *Acting Commissioner of Patents and Trademarks*